United States Patent [19]

Ucci

[11] Patent Number: 4,579,762

[45] Date of Patent: Apr. 1, 1986

[54] STAIN RESISTANT CARPET WITH IMPERVIOUS BACKING

[75] Inventor: Pompelio A. Ucci, Pensacola, Fla.

[73] Assignee: Monsanto Company, St. Louis, Mo.

[21] Appl. No.: 740,448

[22] Filed: Jun. 3, 1985

Related U.S. Application Data

[63] Continuation of Ser. No. 685,865, Dec. 24, 1984, abandoned.

[51] Int. Cl.[4] ..... B32B 3/02

[52] U.S. Cl. ..... 428/95; 428/96; 428/97

[58] Field of Search ..... 428/95, 96, 97

[56] References Cited

U.S. PATENT DOCUMENTS

| | | | |
|---|---|---|---|
| 4,112,161 | 9/1978 | Sorrells | 428/97 |
| 4,264,484 | 4/1981 | Patel | 428/97 |
| 4,346,141 | 8/1982 | Remington | 428/96 |
| 4,355,065 | 10/1982 | De Mott | 428/95 |
| 4,401,704 | 8/1983 | Zegota | 428/96 |

*Primary Examiner*—Marion C. McCamish

*Attorney, Agent, or Firm*—John W. Whisler

[57] ABSTRACT

Carpets having stain resistant pile fibers and a backing that is substantially impervious to water are described. The impervious backing prevents water from passing through the carpet and into the underpad where its presence causes rotting and mildewing of the underpad and other carpet components. The impervious backing also permits washing of the carpet with generous amounts of water without wetting the underpad.

6 Claims, No Drawings

STAIN RESISTANT CARPET WITH IMPERVIOUS BACKING

This is a continuation of application Ser. No. 685,865, Dec. 24, 1984, now abandoned.

BACKGROUND OF THE INVENTION

This invention relates to carpets that resist staining and are substantially impervious to water. By "substantially impervious to water" is meant that when one gallon (3785 ml) of water is poured onto the facing of the carpet from a height of less than 3 centimeters and allowed to stand for sixty (60) hours, less than 300 ml or (8%) of the water passes through the carpet.

The term fiber as used herein includes fibers of extreme or indefinite length (i.e., filaments) and fibers of short length (i.e., staple). The term yarn as used herein means a continuous strand of fibers.

Description of the Prior Art

The typical carpet for residential applications is a wall-to-wall carpet which has a primary backing material, such as polypropylene or jute, stitched with closely spaced erect loops or cut loops of polyamide yarn which extend upwardly from the backing to form a tufted structure (i.e., pile). The underside of the primary backing is coated with an adhesive composition. The adhesive anchors the tufts in the primary backing and is applied to the backing in the form of a latex compounded emulsion which is then dried with heat to cure the adhesive. In most instances, a secondary backing is applied to the underside of the primary backing before the adhesive is dried and cured. The typical carpet is normally installed with an underpad being placed between the carpet and floor. The underpad enhances the cushioning effect and wear-life of the carpet. The carpet and underpad are referred to herein as the carpet system.

The typical carpet system is vulnerable to water and certain dyes that are routinely added as colorants to foods and beverages (e.g. wines, soft drinks, mixes and gelatins), such as FD&C Red Dye No. 40. Such dyes stain nylon fibers. For example, water which spills or otherwise comes into contact with the exposed surface (i.e. facing) of the carpet wets the pile, passes through the primary backing, adhesive composition, secondary backing, and is absorbed by the underpad which serves as a reservoir for the water. Drying of the carpet system, on the other hand, is a slow process in which moisture slowly migrates upwardly from the underpad back through the components of the carpet system to the facing where it then evaporates into the surrounding atmosphere. (The drying time can be lessened somewhat by use of air driers, towels, sponges, vacuums, etc. to remove moisture from the facing.) In the meantime, however the presence of moisture in the carpet system components causes mildew and rotting of the components as well as any wooden floors in contact with the underpad. In the case of urine, there are the additional problems, namely, that of staining and prolonged and offensive odor. In the case of an aritificially-colored soft drink spill, the colorant (e.g. FD&C RED Dye No. 40) not only stains the carpet when it makes initial contact therewith but also restains the carpet during the drying process due to the wicking action of the carpet fibers.

The vulnerability of the typical carpet system to water and water based substances gives rise to a very real dilemma, namely, that of washing the carpet. Normally, if a sufficient amount of water is used to effectively wash stains, soil and odors from the carpet, a portion of the water passes through the carpet and is absorbed by the underpad which is undesirable for reasons given above. On the other hand, if water is sparingly used so as to prevent it from getting down into the underpad effective cleaning of the carpet often is not possible. Therefore, as a practical matter, once the carpet has been stained or otherwise soiled, there is no easy way to effectively remove the stain or soil from the carpet without wetting the underpad and creating yet another and, perhaps, even a more serious problem.

SUMMARY OF THE INVENTION

The present invention provides carpet that resists staining and is substantially impervious to water. According to the preferred embodiment of the invention the carpet comprises a primary backing that is substantially impervious to water and a pile consisting essentially of nylon 6 or nylon 66 fibers shaped from polymer modified to contain as an integral part of its polymer chain aromatic sulfonate units in an amount sufficient to improve the acid dye-resist properties of the fiber.

The carpet of the present invention eliminates the above-mentioned problems associated with corresponding prior art carpets. An important feature of the carpet is that it is both stain resistant and substantially impervious to water. If the carpet were only impervious to water but not stain resistant, an aqueous solution of a staining substance coming into contact with the carpet would spread out over a greater area of carpet and stain the carpet to a greater extent than if the carpet were not impervious to water. On the other hand, if the carpet were stain resistant but not impervious to water, it would be difficult to effectively wash soil from the carpet without wetting the underpad. Also, since the carpet is impervious to water, urine which often by accident comes into contact with carpet in households frequented by infants and house pets cannot penetrate and be absorbed and stored in the underpad and other components of the carpet system.

PREFERRED EMBODIMENTS OF THE INVENTION

The carpet of the invention may be constructed in a conventional manner. According to a preferred embodiment of the invention, the carpet is a cut pile tufted nylon carpet and is made in a conventional manner using commercially available materials, namely, nylon 66 or nylon 6 fibers in the form of a two-ply, staple or continuous filament carpet yarn, jute or polypropylene backing materials and a conventional carpet backing adhesive composition with the exception that (1) the adhesive composition contains a fluorochemical in an amount sufficient to render the backing a barrier to liquids and (2) the nylon fibers are shaped from polymer modified to contain as an integral part of its polymer chain sufficient aromatic sulfonate units to improve the acid dye resistant properties thereof.

Adhesive compositions which may be used in providing the carpet of the present invention comprise a mixture of a latex of a synthetic polymer known to be usable for binding tufts of fiber in carpet primary backings, filler (e.g. $CaCO_3$) and other additives (e.g. thickeners, fungicides, etc.). Such polymers are capable of being prepared in uniform aqueous colloidal dispersions having spherical particles averaging 0.2 microns in diameter and include, but are not limited to, polyvinyl acetates, polyacrylates, polyethylene-vinylacetate copolymer, styrene-butadiene copolymers (SBR) and/or carboxy styrene-butadiene copolymers.

Fluorochemicals which may be added to the adhesive composition in accordance with the present invention are commercially available and include those available from Minnesota Mining and Manufacturing Company under the tradename Scotchguard ®, such as, Scotchgard 352, from E. I. DuPont de Nemours and Company under the tradename Teflon and from American Hoechst Corporation under the tradename Nuva ®. The same fluorochemical may be used for both applications.

It has been found that the amount of fluorochemical required to provide a primary backing that is substantially impervious to water will depend on the particular fluorochemical and adhesive composition selected. In general, amounts ranging from 0.1 to 1.0% by weight of the fluorochemical, based on weight of adhesive composition, are sufficient with amounts ranging from 0.2 to 0.4% by weight usually being sufficient. Preferably, as little of the fluorochemical as possible is used in order to minimize the overall cost of the carpet.

Modified nylon 6 and nylon 66 polymer useful in practicing the present invention may be easily prepared by art recognized techniques. Accordingly to these techniques the polymer is prepared by replacing a portion of the nylon-forming monomers with a corresponding molar amount of an appropriate sulfonated aromatic monomer. For example, in the case of nylon 66 the adipic acid is replaced by a corresponding amount of

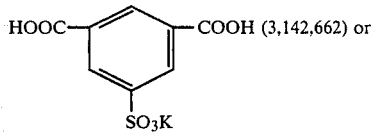

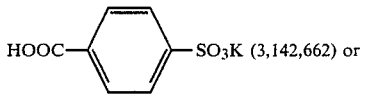

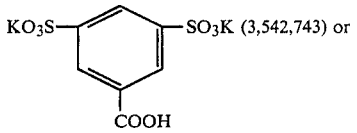

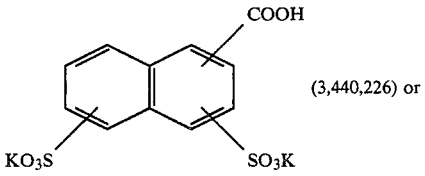

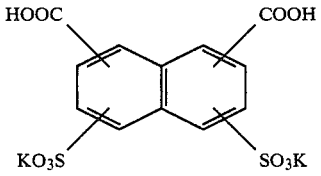

In the case of nylon 6, the polymer is similarly modified by adding an appropriate amount of a monomer, for example

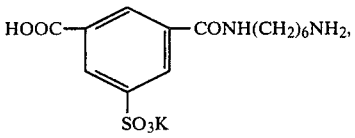

to the caprolactam monomer.

The preferred aromatic sulfonated monomer for use in practicing the invention is chain-extending monomer of the formula

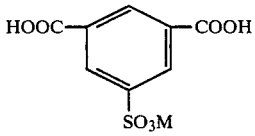

where M is hydrogen, the ammonium radical or an alkali metal and preferable is sodium or potassium. Usually an effective amount of the sulfonated monomer will be in the range of 0.25 to 2.5 molar percent, based on the moles of nylon.

The following examples are given to further illustrate the invention.

EXAMPLE 1

In this example, the staining of cut pile tufted carpet prepared from nylon 66 fibers modified in accordance with the present invention is compared to that of corresponding carpet prepared from standard nylon 66 fibers.

Nylon 66 polymer modified to contain 4300 ppm of the potassium salt of 5-sulfoisophthalic acid

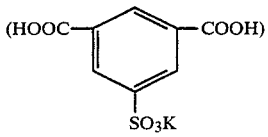

was prepared in a conventional matter by adding the salt to nylon 66 salt prior to polymerization.

A 310 filament, 60 denier per filament (dpf), undrawn nylon 66 yarn was prepared by conventional procedures. Fifty-four (54) such yarns were combined to form a tow having a total denier of about 1,000,000. The tow was drawn over rolls to provide nominal 18 dpf tow, crimped in a conventional stuffer box and cut into 7½ inch (19.05 cm) staple. The staple was carded, drafted and spun on a conventional ring spinning frame to provide a 2½ cotton count yarn having about 4.5 tpi (177 tpm) of twist in the Z-direction. Two of these yarns were plied on a conventional ring twister to provide a plied yarn having a net twist of 0 tpi in the Z-direction and 3 tpi (118 tpm) in the S-direction. The resulting plied yarn was then heatset. Cut pile carpet was made by tufting the heatset plied staple yarn into a polypropylene primary backing in a conventional manner. The carpet was then dyed to a light gold color in a conventional beck dyeing operation in which the carpet was immersed in an aqueous dye bath contained within a vessel. For purposes of comparison a second carpet (Control) was made in the same manner, except in this instance the nylon 66 polymer from which the staple was prepared was standard unmodified nylon 66.

Both carpets were used in conducting the following stain tests:

TEST A

An aqueous solution of FD&C Red Dye No. 40 and citric acid in which the concentration of the dye was 0.08 grams/liter and that of the acid was 0.4 grams/liter was prepared. This solution simulates store-bought soft drink mixes containing the Red Dye and has an optical density of 3.5 and a pH of 3.0. A plastic pipe measuring about 3.8 cm in diameter and 5.0 cm in length was placed upright on the carpet prepared from the modified nylon 66 staple. Into the open end of the pipe was poured 10 cm of the prepared dye solution. The solution was permitted to soak into the carpet thereby forming a wet spot on the carpet. Four additional spots were made on the carpet using this procedure. Each spot was later washed with water in an attempt to remove all of the dye or as much of the dye as possible from the carpet. The period of time during which the solution was left in contact with the carpet was different for each spot. These periods of time were one, two, four, six and eight hours. The staining of the carpet by the Red Dye was then rated using a scale of one to eight corresponding to the International Gray Scale for staining where scale step 1 is completely stained (black) and scale step 1 is stained (white). The rating of each of the five spots was visually obtained and the five ratings averaged. In this instance, the averaged rating was 5.12. The Control carpet was then subjected to the same test. In this instance the average of the five spot ratings was 1.28. This test shows that carpet prepared from nylon 66 staple fiber modified in accordance with the present invention is stained by the dye to a much lesser extent than carpet prepared from unmodified nylon 66 staple fiber.

TEST B

Samples of the modified nylon 66 fiber and unmodified (standard) nylon 66 fiber were taken from the appropriate carpet. The samples were tested to determine their ability to resist staining by the above red dye solution. In this test, the optical density of a weighed amount of the dye solution was measured on a Carey 15 Spectrophotometer using a ½ cm cell with the light absorption being measured at 520 millimicrons. (Light absorption is a measure of dye concentration of the solution.) The light absorption reading was recorded as $T_0$. The solution was put into a stoppered container with a sufficient amount of fiber sample to provide a weight ratio of drink to fiber of 40:1. The stoppered container of solution and fiber was then shaken on a motorized shaker for a period of one hour while maintaining its temperature at 80° C. The fiber was then removed from the container and the optical density of the solution was determined as before. The reading this time was recorded at $T_1$. (If the fiber sample did not resist staining, i.e., took up dye from the solution, the $T_1$ value was less than the $T_0$ value; on the other hand, if the fiber sample resisted staining, i.e. took up no dye, the $T_0$ and $T_1$ were the same.) In order to compare samples the test results were expressed as a change in light penetration, expressed as a percentage, calculated as follows:

$$\% = \frac{T_0 - T_1}{T_1} \times 100.$$

The lower the percentage, the more resistant the yarn was to staining. In these experiments, samples of the 5-sulfoisophthalic acid modified nylon 66 fibers gave a test value of 3.4%, whereas samples of the unmodified, standard nylon 66 fibers gave a test value of 100%.

EXAMPLE 2

This example illustrates the carpet having an impervious backing in accordance with the present invention.

A carpet was prepared as described in Example 1 using the standard nylon 66 staple fiber referred to therein, except in this instance the carpet backing adhesive composition used in making the carpet was a carboxy styrene-butadiene latex obtained commercially from Textile Rubber and Chemical Company under the designation L-1254 to which had been added with stirring 0.25% by weight, based on the weight of the latex, of a fluorochemical obtained commercially from Minnesota Mining and Manufacturing Company under the tradename Scotchgard ®352. The resulting latex was applied to the primary backing of the carpet in a conventional manner in an amount of 25–60 ox./yd$^2$ of carpet and then a secondary backing was applied to the primary backing before the adhesive was dried and cured.

One gallon (3785 ml) of water was poured onto a sample of the above-identified carpet (invention) from a height of less than 3 centimeters and allowed to stand for 60 hours. After the 60-hour period, examination of the carpet sample revealed that during the 60-hour period only 90 ml of water had passed through the primary backing of the carpet sample. For purposes of comparison, one gallon (3785 ml) of water was also similarly poured onto a sample of store-bought carpet (control). The carpet was similar in construction to the above invention carpet sample. After 20 minutes, examination of this sample revealed that 2000 ml of water had already passed through the primary backing of the sample.

EXAMPLE 3

A carpet is prepared as described in Example 1 using staple fiber shaped from nylon 66 polymer modified to contain 4300 ppm of the possium salt of 5-sulfoisophthalic acid and the Scotchguard fluorochemical-containing adhesive described in Example 2.

The carpet resists staining otherwise caused by colorants found in common household foods such as soft drinks premixes, wines, coffee, gelatines, etc. The carpet also can be washed with generous amounts of water without substantial amounts of the water penetrating through the carpet components into the under pad. Also, the carpet is protected against pet and infant wetting accidents which otherwise often lead to staining and prolonged odor problems.

We claim:

1. A carpet comprising a primary backing coated with an adhesive composition and a pile consisting essentially of fibers attached to said primary backing, said carpet being characterized in that said fibers are shaped from nylon 66 or nylon 6 polymer modified to contain as an integral part of its polymer chain aromatic sulfonate units in an amount sufficient to improve the acid dye-resist properties of said fibers and said adhesive composition contains a fluorochemical in an amount sufficient to render said backing substantially impervious to water.

2. The carpet of claim 1 where said polyamide fibers are nylon 66 fibers.

3. The carpet of claim 1 wherein said aromatic sulfonate units are of the formula

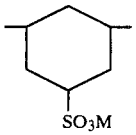

where M is hydrogen, the ammonium radical or an alkali metal.

4. The carpet of claim 1 wherein M is sodium or potassium.

5. The carpet of claim 1 wherein said fibers are staple fibers.

6. The carpet of claim 1 wherein the carpet includes a secondary backing.

* * * * *